United States Patent [19]

Lilie

[11] Patent Number: 4,960,368

[45] Date of Patent: Oct. 2, 1990

[54] SUCTION SYSTEM FOR HERMETIC COMPRESSOR OF REFRIGERATION

[75] Inventor: Dietmar E. B. Lilie, Joinville, Brazil

[73] Assignee: Empresa Brasileira de Compressores S/A-Embraco, Joinville-Sc, Brazil

[21] Appl. No.: 365,375

[22] Filed: Jun. 12, 1989

[30] Foreign Application Priority Data

Jul. 29, 1988 [BR] Brazil ..... 8804016

[51] Int. Cl.[5] ..... F04B 39/00

[52] U.S. Cl. ..... 417/312; 417/542

[58] Field of Search ..... 417/902, 313, 542, 415

[56] References Cited

U.S. PATENT DOCUMENTS

| | | | |
|---|---|---|---|
| 4,582,468 | 4/1986 | Bar | 417/312 |
| 4,755,108 | 6/1988 | Todescat et al. | 417/902 |
| 4,759,693 | 6/1988 | Outzen | 417/312 |

*Primary Examiner*—Donald E. Stout
*Assistant Examiner*—John A. Savio, III
*Attorney, Agent, or Firm*—Darby & Darby

[57] ABSTRACT

The type which comprises a motor-compressor unit, suspended inside a housing with suction and discharge connectors and formed by a block, supporting a motor incorporating at least one discharge muffler, one cylinder with head lodging chambers and suction and discharge valves and a suction system admitting refrigerating gas coming from the suction connector of the housing and conveying it to the cylinder. In accordance with the invention, the system comprises a suction muffler (110) and one inside lining element (120) of the suction chamber built in one single hollow and airtight unit, while inside the suction muffler (110), at least two chambers (111, 112) are defined, interconnected one to the other by an internal peripheral communication duct (113), with inlet and outlet ends axially aligned and separated with relation to the outlet end of an internal peripheral inlet duct (115) and a gas outlet opening (116), respectively.

8 Claims, 2 Drawing Sheets

SUCTION SYSTEM FOR HERMETIC COMPRESSOR OF REFRIGERATION

BACKGROUND OF THE INVENTION

This invention refers to a suction system for reciprocating type hermetic compressor used in refrigeration appliances. The suction systems used in reciprocating type hermetic compressors normally consist of a set which includes chambers, ducts, plates and deflectors, the function of which is to damp the pulsations of the refrigerating gas, making the gas flow as uniform as possible.

These units are normally manufactured of insulating plastic material, in order to avoid that the refrigeration gas becomes overheated when coming into contact with hot metallic components of the compressor, mainly the head and the cylinder. This overheating results in a reduction of the refrigeration gas density which, in turn, brings about a reduction of the flow of mass admitted and compressed by the compressor and its consequent efficiency drop.

Although the known suction systems reduce up to a certain degree the refrigeration gas overheating in suction, they are still deficient and, above all, problematic with regard to its manufacture.

A known system is presented by the U.S. Pat. No. 4,370,104, which describes a suction muffler unit consisting of two parts of plastic material assembled in the block. One of the parts has a cylindrical form with a cup-shaped end and this end has an opening for the introduction of a metallic tube for suction connected to the cylinder head. The other part, also cup-shaped, is assembled on the open end of the first part and presents a nozzle projected towards the compressor housing suction tube.

One deficiency of this muffler is that it does not prevent the refrigeration gas from being heated along the suction metallic tube and in the suction chamber inside the head.

As to the filtering, this muffler of the prior art presents great problems due to the fact that it is formed in one single volume (chamber). And due to this fact, the loss of filtering in the muffler is approximately 40dB/decade, which corresponds to the filtering effect of a volume and a tube.

Another known system is the one of U.S. Pat. No. 4,449,610. This one presents a suction muffler consisting of a plastic material body with two chambers interconnected by a slot and directly assembled on the compressor head by means of two small tubes provided with adequate sealing means.

Similarly to the above described system, this other muffler also shows deficiencies regarding the insulation of gas in suction, since it does not avoid that the refrigerating gas is heated in the suction chamber.

Another deficiency of this second system is that in order to obtain a satisfactory acoustic effect, it tubes have a very reduced diameter, which results in a considerable restriction of refrigerating gas flow, increasing the energy losses in the suction.

Another suction system is, further, described in the patent document EPO 195 486 A2. This system consists of one suction chamber made of synthetic material as a separate part of the head so as to reduce the heat transfer from the head to the suction chamber. This chamber is formed integrally with the suction muffler and takes the shape of an appendage. An additional heat transfer reduction for the refrigerating gas is obtained by means of an elastic connection between the suction-tube and the suction muffler. Although this suction system reduces considerably the heat transfer from the head to the refrigerating gas, it presents serious problems regarding the oil circulation, since it does not provide an oil separator, a necessary element in direct suction systems. The accumulation of oil in the suction chamber may cause oil suction to the cylinder, resulting in damage of the valves and breakage of the crankshaft.

Another deficiency of this system refers to its low efficiency as an acoustic filter when restrictions are imposed on the gas flow by the interconnection holes of the two suction muffler volumes, since these restrictions produce a low acoustic impedance in relation to the pressure loss, imposed on the suction gas. This low acoustic impedance results in a weak attenuation of suction noise.

OBJECTS OF THE INVENTION

The general protrude of this invention is to propose a suction system which overcomes the above described deficiencies.

The purpose of this invention is also to present a suction system wherein the refrigerating gas flow is insulated from the metallic parts of the compressor along its entire travel towards the cylinder and which has, at the same time, a good efficiency an as oil separator.

A further purpose of this invention is to present a suction system, in which the acoustic filter or filters have good characteristics for attentuating noise and gas pulsation without however causing considerable flow losses.

A further purpose of this invention is to propose a suction system, the structural elements of which may be manufactured as integral elements of the same set, making assembly and welding operations unnecessary.

BRIEF DESCRIPTION OF THE INVENTION

These purposes are achieved in a compressor which comprises a motor-compressor unit suspended inside a hermetic housing provided with suction and discharge connectors, said motor-compressor unit being provided with: a block supporting a motor incorporating at least one discharge muffler, a cylinder having a head which houses chambers and suction and discharge valves and a suction system which admits the refrigerating gas discharged inside the housing through the mentioned suction connector and discharges it in the cylinder.

In accordance with this invention, the suction system comprises: a muffler with the form of a small airtight housing of thermo insulating plastic material, assembled externally on the head, having at least two internal and adjacent chambers, in fluid communication one with the other through an inside communication duct formed next to the peripheral wall of the small housing, the latter having a gas inlet opening, communicating with a first of said chambers through an inlet duct formed, internally, next to the peripheral wall of the small housing and having its outlet end axially aligned and separated in relation to the communication duct inlet end, arranged inside the mentioned first chamber and the small housing and having a gas outlet opening in communication with the last of said chambers and arranged axially aligned and separated in relation to the outlet end of the communication duct placed in the last chamber. The unit also has an inside lining element of the suction chamber in the shape of a hollow body, with a gas inlet opening, defined by the gas outlet opening of the small housing, and a gas outlet opening in communication with the cylinder suction valve; the small housing, its inside chambers, the communication and inlet ducts and the body of the inside lining being formed in one single unit, defined by two juxtapositioned halves.

In the so constructed suction muffler system, the internal chambers of the system act analogously to capacitive filters, whilst the ducts act as inductive filters. The intercommunication of the chambers is made by means of a duct, thus obtaining a better acoustic attenuation without imposing great restrictions on the refrigerating gas flow. In the previously described compressors, this acoustic attenuation was obtained by means of openings of tubes with small diameter, causing considerable losses in the refrigerating gas flow.

Another advantage of the described system is that is does not need oil separators, since the suction of gas is semidirect, i.e., the suction connector is not directly connected to the muffler. The reduction of the suction gas overheating is obtained due to the total insulation of the suction system including the muffler, its inside elements and the part of lining of the suction chamber.

BRIEF DESCRIPTION OF THE DRAWINGS

The invention will be described hereafter, making reference to the attached drawings, where.

DETAILED DESCRIPTION OF THE INVENTION

Figure 1:
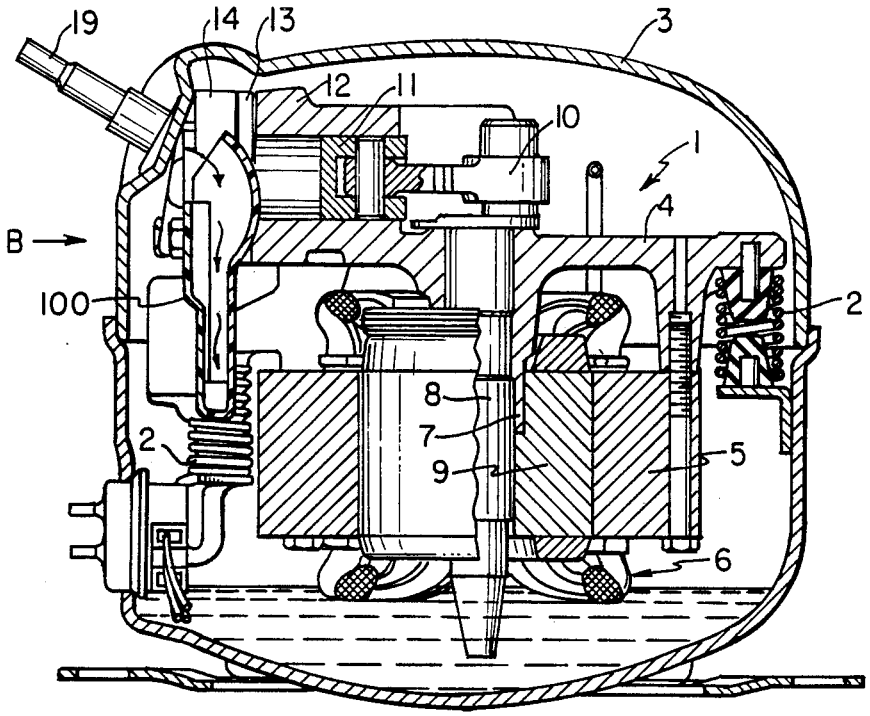
FIG. 1 shows a vertical-longitudinal sectional view of a compressor, according to this invention.

As above listed figures illustrate, the motor-compressor unit 1 is suspended by means of springs 2 inside the housing 3. The motor-compressor unit 1 consists of a block 4, which supports a stator 5 of the electric motor 6 and incorporates a bearing 7 for a crankshaft 8. The crankshaft 8 rotates simultaneously with the rotor 9 of the electric motor 6, driving by means of the connecting rod 10, the piston 11, which is reciprocating inside the cylinder 12.

Figure 2:
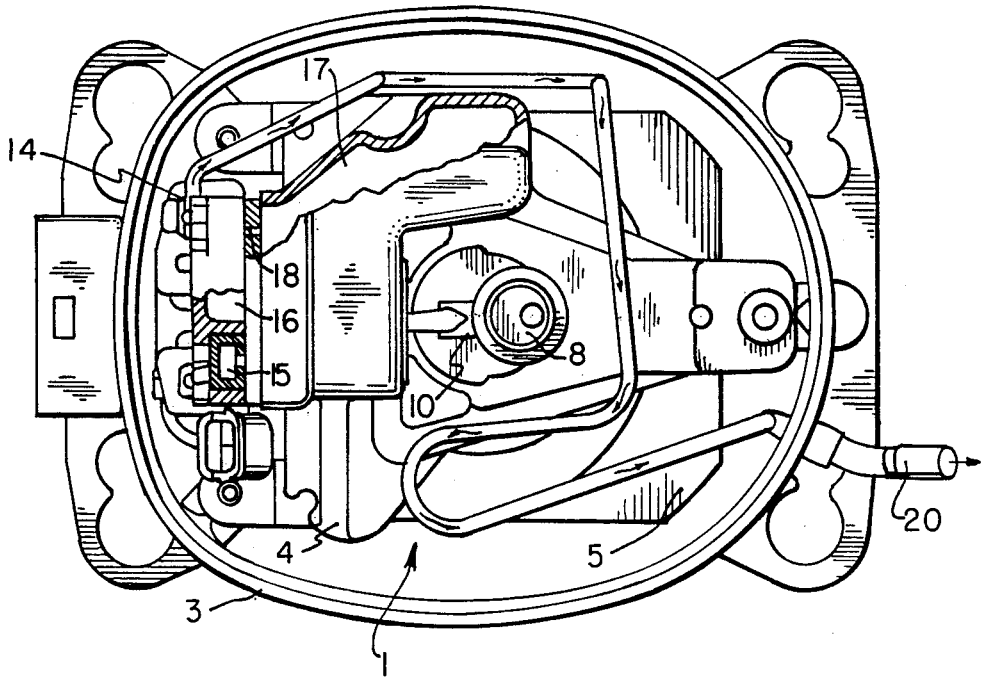
FIG. 2 is the top view of the compressor shown in FIG. 1, without the housing cover.
Figure 3:
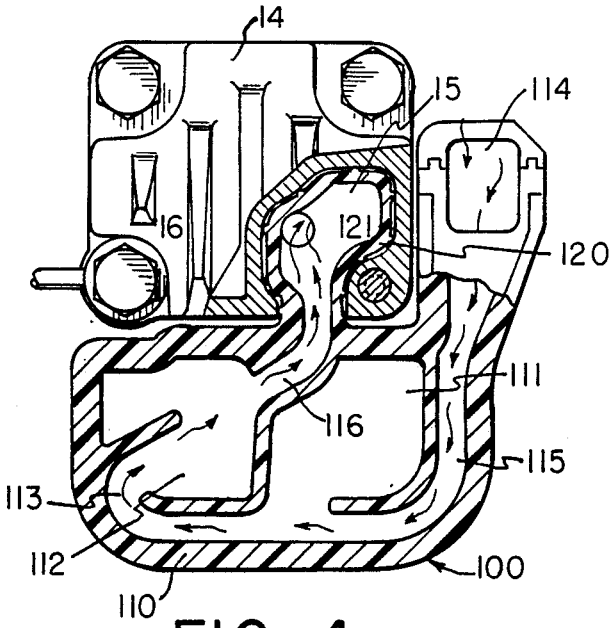
FIG. 3 shows a partial section of the cylinder head and suction system of the compressor illustrated in FIG. 1, represented according to the direction "B"

On the top of the cylinder 12, a plate of valve 13 and a head are fastened, the latter provided with two inside cavities open towards the surface adjacent to the plate of valve 13 and which define the suction chamber 15 and the discharge chamber 16, as is shown in FIGS. 2 and 3. Block 4 also incorporates a discharge muffler 17, which is connected to the discharge chamber 16 formed at the head 14, by means of a duct 18, formed in the block 4.

In the housing 3 are also welded the suction connector 19 and the discharge connector 20, which is connected to the discharge muffler 17.

In accordance with FIGS. 1, 3, 4 and 5, the suction system 100 in question comprises, basically, a suction muffler 110 and an inside lining element 120 of the suction chamber.

The suction muffler 110 is shown in the form of a small airtight housing made of insulating plastic material, assembled externally to the head 14. This small housing 110 has two internal and adjacent chambers 111 and 112, connected one to the other by means of an elongated inner duct 113, formed next to the peripheral wall of the small housing 110.

The small housing 110 has a gas inlet opening 114, arranged so as to receive the refrigerating gas flow coming from the suction connection 19 and is interconnected to the inside of a first 111 of the two adjacent chambers 111 an 112, through an elongated inlet duct 115, formed, internally, next to the peripheral wall of the small housing 110 and having its outlet end open towards the inside of the first chamber 111 and axially aligned and separated in relation to the inlet end of the intercommunication duct 113 of the adjacent chambers 111 and 112. The second chamber 112 has the outlet end of the communication-duct 113 bent inwards in a diagonal or diametral direction in relation to the contour of the second chamber 112, to be positioned in an axially aligned manner and separated from a gas outlet opening 116 of the small housing 110; said opening 116 is defined on the wall of the second chamber 112, opposed to the one which contains the end of the bent outlet of the interconnection duct 113.

The inside lining element 120 of the suction chamber 15 has the form of a hollow body, also made of insulating plastic material, externally incorporated to the small housing 110 which defines the suction muffler and is kept in fluid communication with the inside of the latter through a gas inlet opening which merges with the gas outlet opening 116 of the small housing 110. The inside lining element 120 of the suction chamber 15 also has a gas outlet opening communicating with the suction valve of the valve plate 13 and, by means of the latter, with the cylinder inside.

As shown in FIGS. 1 to 4, the lining element 120 is lodged inside the suction chamber 15 so as to fully cover its inside, the connection between the body of the lining element 120 and the muffler housing 110 being obtained by means of a constrictive passage, containing the gas inlet and outlet opening 116 of the small housing 110 and of the hollow body 120, respectively, and arranged through the corresponding inlet opening of the suction chamber, in order to maintain the small housing 110 slightly separated from the head-cylinder assembly.

Figure 4:
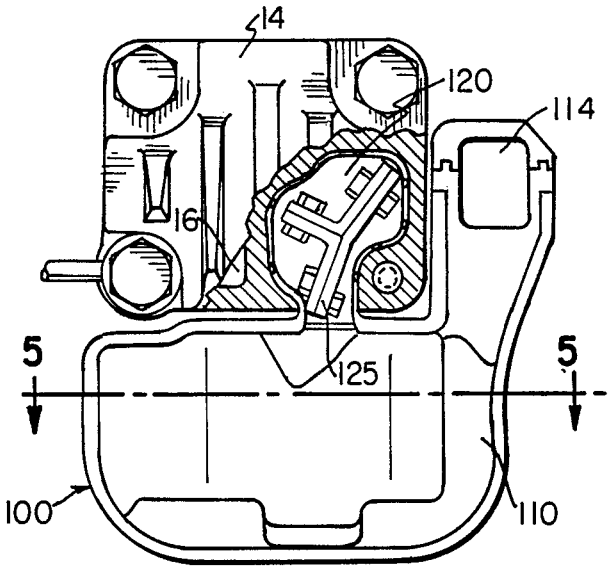
FIG. 4 shows the end (front) view of the cylinder head and suction system assembly, when observed in the direction of the arrow "B" in FIG. 1, the cylinder head being partially shown in section to illustrate the retaining spring of the suction system.

As can be seen in FIG. 4, the lining element 120 has a sealing device which comprises a spring 125 and a gasket (not illustrated), which serves to seal the clearance between the gas outlet opening 121 of the hollow body and the valve plate 13, preventing gas from leakage by the periphery of the mentioned opening 121 through the space between the surface of the inside lining element 120 of the suction chamber 15 and the surface of the valve plate 13 on which the mentioned inside lining element 120 of the suction chamber 15 is seated.

The spring 125 is assembled between the head 14 and the adjacent wall of the hollow body 120 of the inside lining element of the suction chamber 15, exerting pressure on three points of the mentioned wall of the lining element. This spring 125 ensures that the compression of the referred joint (not shown in the illustration) is maintained along the time, compensating possible dimensional variations, which the material may undergo.

Figure 5:
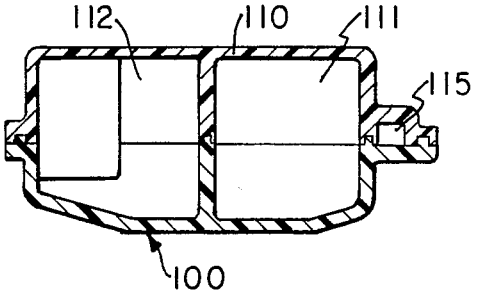
FIG. 5 shows a view of the suction system according to a cut taken in the direction of the V—V line of FIG. 4.

One of the aspects to be mentioned is that the small airtight housing of the suction muffler 110, the inside partitions of the same which defines the first 111 and the second 112 chamber and the ducts 113 and 115 and, further, the hollow body of the lining element 120 of the suction chamber 15, form one single unit of thermoinsulating material. This unit is formed from two molded halves, which are fitted and welded one to the other according to a transversal plan and sectioning the hollow body 120 and the two chambers 111 and 112, the ducts 113 and 115 and the gas outlet opening 116 of the small housing 110, such as is shown in FIG. 5.

The arrangement of ducts 113 and 115 next to the peripheral wall of the small housing 110 permits a better use of the available space and of the inside volume of the chambers 111 and 112, besides offering more economy of raw material in the manufacture of the assembly.

This peripheral or marginal arrangement of the ducts 113 and 115, along with the relative axial positioning between the same and between the outlet of the interconnection duct 113 and the gas outlet opening 116 of the small housing 110, also permits to obtain an optimum relation between the acoustic impedance obtained and the pressure loss imposed on the suction gas, during its travel through the suction muffler.

I claim:

1. A suction system for a hermetic compressor, said compressor comprising:

a cylinder block;

a piston;

means for reciprocating said piston within said cylinder;

head means for said cylinder having suction and discharge chambers;

a value plate on the cylinder having suction and discharge valves communicating with the suction and discharge chambers of the head;

a suction muffler comprising:

a housing formed with first and second internal chambers;

an inlet to said housing to supply refrigerant gas;

an elongated duct formed on the internal periphery of said housing with a first and a second portion each having an inlet and an outlet end, the inlet end of said duct first portion in communication with the housing inlet for that refrigerant gas, the wall area of said first chamber having an opening in communication with the outlet end of said duct first portion;

the inlet end of said duct second portion being axially aligned with the outlet end of said first duct portion;

an opening in the wall area of said second chamber at which the outlet end of said second duct portion is in communication to supply the refrigerant gas to said second chamber, an outlet section formed integrally with said housing; to be mounted to the cylinder within the head, said outlet section having a plenum overlying the suction valve of the valve plate;

and a gas outlet passage formed in said housing from the outlet of said second chamber to the inlet of said plenum of the outlet section.

2. A suction system for a hermetic compressor according to claim 1, wherein the of outlet passage of the housing is provided as a part of the peripheral wall of the housing opposed to the one adjacent to the outlet end of the duct second portion and is bent inwards of the inlet to the second chamber in a diagonal diametral direction in relation to the contour of said second chamber.

3. A suction system for a hermetic compressor according to claim 1, wherein the housing and the outlet section are molded of thermoinsulating plastic material, compatible with the internal conditions of the compressor housing.

4. A suction system for a hermetic compressor according to claim 1 further comprising a spring between the inside wall of the head and the adjacent wall of the outlet section to force the opposite wall of the latter towards the suction and discharge valves on said valve plate.

5. A suction system for a hermetic compressor as in claim 9 wherein the gas outlet passage from said second chamber is formed on the internal wall of the housing, the inlet of said gas outlet passage being generally aligned with the outlet end of said duct second portion at the inlet to said second chamber.

6. A suction system for a hermetic compressor as in claim 1 wherein the outlet passage and surrounding wall between the housing second chamber and the plenum of the outlet section is constricted to provide a separation of the cylinder-head and the muffler housing.

7. A suction system for a hermetic compressor, according to claim 1, wherein the housing including the outlet section is formed by two juxtapositioned halves fitted and welded one to the other.

8. A suction system for a hermetic compressor according to claim 7, wherein the two halves of the suction muffler unit are welded one to the other, according to a transversal plane sectioning the housing the two chambers, the first and second portions of the duct and the hollow body of the outlet section.

* * * * *